United States Patent [19]

Yoshida et al.

[11] Patent Number: 4,744,800

[45] Date of Patent: May 17, 1988

[54] GASOLINE COMPOSITIONS FOR AUTOMOTIVE VEHICLES

[75] Inventors: Eiichi Yoshida, Yokohama; Hirotsugu Nomura, Chigasaki; Shoichi Satoh, Yokohama, all of Japan

[73] Assignee: Nippon Oil Co., Ltd., Tokyo, Japan

[21] Appl. No.: 818,353

[22] Filed: Jan. 13, 1986

[30] Foreign Application Priority Data

Jan. 18, 1985 [JP] Japan ..... 60-7130
Jan. 29, 1985 [JP] Japan ..... 60-14795
Jan. 29, 1985 [JP] Japan ..... 60-14796

[51] Int. Cl.[4] ..... C10L 1/18

[52] U.S. Cl. ..... 44/70; 123/1 A; 252/400.61

[58] Field of Search ..... 44/77, 78, 76, 70; 123/1 A; 252/400.6, 400.61, 400.62

[56] References Cited

U.S. PATENT DOCUMENTS

| | | | |
|---|---|---|---|
| 2,524,864 | 10/1950 | Wies et al. | 44/77 |
| 2,527,987 | 10/1950 | Caron et al. | 44/77 |
| 2,579,890 | 12/1951 | Wies et al. | 44/77 |
| 3,328,284 | 6/1967 | Godar | 44/77 |
| 3,410,670 | 11/1968 | Le Suer | 44/78 |
| 3,594,140 | 7/1971 | Badin | 44/77 |
| 3,891,401 | 6/1975 | Watson et al. | 44/77 |

*Primary Examiner*—William R. Dixon, Jr.
*Assistant Examiner*—Margaret B. Medley
*Attorney, Agent, or Firm*—Bucknam and Archer

[57] ABSTRACT

A motor gasoline composition for use in automotive vehicles is disclosed. A selected gasoline fraction is combined with a specified amount of a selected alkali earth metal salt whereby plug fouling inhibiting ability is greatly improved.

7 Claims, No Drawings

GASOLINE COMPOSITIONS FOR AUTOMOTIVE VEHICLES

BACKGROUND OF THE INVENTION

1. Field of the Invention

This invention relates to motor gasoline compositions suitable for use in automotive vehicles.

2. Prior Art

Spark plugs are susceptible to fouling in automobile engines particularly where lead-free gasoline is used. Plug fouling is the phenomenon in which the spark plugs are covered with deposits at their insulator legs and electrodes and which is more likely to occur during cold winter season. Plug fouling causes starting difficulty and unstable operation of the engines at low speed, and further invites insufficient acceleration.

It is known that plug fouling takes place more frequently the higher in aromatics contents and the heavier the lead-free gasoline.

This problem has been coped with by using spark plugs of high quality as regards their construction and thermal value, or by avoiding prolonged operation of engines in an excessively rich air-fuel mixture. A keen demand has been voiced for improved means capable of protecting spark plugs from fouling without resort to modifications of the construction and operation of spark plugs per se.

It has now been found that spark plug fouling can be eliminated by the addition of specific alkali earth metal salts even where heavy, aromatics-rich lead-free gasoline is used.

In the meantime, agents other than conventional alkylated lead have been proposed to increase the octane number of motor gasolines. It has also been proposed to this end to modify the hydrocarbon composition of gasoline itself, for example by using high aromatic components so as to attain an octane number as high as 95 or even higher than 98. The gasoline composition of the invention can be of this high octane class, and yet is free from spark plug fouling.

The present invention seeks to provide a novel gasoline composition which is effective in particular for inhibiting spark plug fouling.

This and other objects and advantages of the invention can be achieved by the provision of a gasoline composition for automotive vehicles which comprises a gasoline fraction having an aromatics content of greater than 35 volume percent and a 50 percent distillation temperature of 85° to 125° C., and a specified amount of a selected alkali earth metal salt.

DETAILED DESCRIPTION OF THE INVENTION

By the term "gasoline fraction" as used herein is meant petroleum fractions distilling at temperatures of about 35° to 200° C., specific examples of which are gasolines for automobile engines stipulated by the Japanese Industrial Standards (JIS) K2202. The present invention contemplates the use of gasoline fractions having an aromatics content of greater than 35 volume percent, preferably 35 to 60 volume percent, and a 50 percent distillation temperature of 85° to 125° C. The aromatics contents are those measured in accordance with JIS K2536 for the Testing Method for Hydrocarbon Types in Petroleum Products by Fluorecent Indicator Adsorption. The 50 percent distillation temperatures are those measured in accordance with JIS K2254 for the Testing Method for Distillation of Petroleum Products.

Suitable alkali earth metals include for example magnesium, calcium, barium and the like.

Alkali earth metal salts eligible for the purpose of the invention are alkali earth metal sulfonates, alkali earth metal phenates and alkali earth metal salicylates.

Eligible alkali earth metal sulfonates are alkali earth metal salts of aromatic alkylsulfonic acids having a molecular weight of about 100 to 700. The alkylsulfonic acids include petroleum sulfonic acids and synthetic sulfonic acids. Examples of the petroleum sulfonic acids are those obtained by sulfonating alkyl aromatics contained in lubricant fractions of mineral oils. Examples of the synthetic sulfonic acids are those resulting from the sulfonation of alkylbenzenes containing straight or branched alkyl groups, which alkylbenzenes are obtainable for example as side products from detergents manufacturing plants, or from the alkylation of polyolefins into benzene, or from the sulfonation of alkylnaphthalenes such as dinonylnaphthalene.

Eligible alkali earth metal phenates are alkali earth metal salts of alkylphenols of the formulae

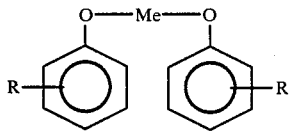

and

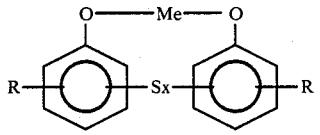

where R is an alkyl group of 4 to 40 carbon atoms, x is an integer of from 1 to 2 and Me is an alkali earth metal.

The alkylphenols are those resulting from the alkylation into benzene of olefins and alcohols (produced as by oligomerization of propylene) and waxes in the presence of Friedel-Crafts catalysts. A typical method of preparing such alkali earth metal phenates involves reacting alkylphenols, sulfur and alkali earth metal hydroxides in a solvent such as methanol, butanol or ethylene glycol at from room temperature to 200° C.

Eligible alkali earth metal salicylates are alkali earth metal salts of alkylsalicylic acids containing at least one, preferably one to two, alkyl group of more than 3 carbon atoms, preferably 8 to 40 carbon atoms. The method of preparation of alkylsalicylic acids is optional. One such method involves forming an alkylphenol by alkylating a phenol or cresol with an olefin, followed by conversion to corresponding alkylphenol with alcoholic sodium hydroxide, treating the resulting alkylphenate with carbon dioxide gas at elevated temperature and pressure to form an alkylsalicylic acid sodium salt, and subsequently reacting this salt with an acid. Another method is to alkylate salicylic acid with an olefin using a catalyst such as boron fluoride.

The alkali earth metal salts contemplated by the invention may be used in the form of basic and ultrabasic salts, let alone neutral salts (normal salts).

The alkali earth metal sulfonates include basic sulfonates obtainable by heating sulfonates and excess alkali earth metals in the presence of water, and ultrabasic sulfonates resulting from reacting sulfonates with alkali earth metal oxides or hydroxides in the presence of carbon dioxide gas.

The alkali earth metal phenates include basic phenates obtainable by heating phenates and excess alkali earth metals in the presence of water, and ultrabasic salts resulting from reacting phenates with alkali earth metal oxides or hydroxides in the presence of carbon dioxide gas.

The alkali earth metal salicylates include not only neutral salts obtained by reacting sodium salts of alkylsalicylic acids with equimolar alkali earth metal halides, but also basic salts obtained by reacting alkylsalicylic acids with alkali earth metal hydroxides, and ultrabasic salts resulting from reacting alkylsalicylic acids with excess alkali earth metal hydroxides in the presence of carbon dioxide gas.

The methods of preparing the aforesaid basic and utlrabasic salts are optional, and bear no limitation upon the scope of the invention.

The amount of each of the above described alkali earth metal salts to be added is in the range of 0.01 to 1.0 weight percent, preferably 0.1 to 0.5 weight percent based on the gasoline fraction. Smaller amounts would fail to provide sufficient protection of spark plugs against fouling, while larger amounts would produce no better results but would only add to increased accumulation of deposits in the combustion chamber.

The gasoline composition of the invention which contains either of the alkali earth metal salts can be charged as it is into the fuel tank. Alternatively, it is possible to charge a predetermined amount of a given alkali earth metal salt into the fuel tank which has already been filled with the gasoline.

There may be used other additives such as antioxidants, metal deactivators, surfactants, fuel aids, antistatic agents, dyes and the like.

To provide improved octane number, there may also be used ethers such as methyl-t-butylether and isopropyl-t-butylether, and alcohols such as methanol, ethanol and isopropanol. The amounts of these ethers and alcohols to be added are optional, generally in the range of 1 to 60 weight parts, normally in the range of 1 to 25 weight parts per 100 weight parts of the gasoline composition.

The invention will be further described by way of the following examples, in which the gasoline compositions of the invention and the conventional gasoline fuels were subjected to the performance test described below.

PERFORMANCE TEST

A test vehicle equipped with new spark plugs of the manufacturer's specification was started on a chassis dynamometer at a room temperature of 0° C. and accelerated and decelerated alternately every two minutes. This mode of operation was repeated three times, whereupon the car was stopped for a period of 54 minutes. This constitutes a cycle of test run. The car was brought to a stop upon completion of 12 cycles for visual inspection of each set of spark plugs associated with each of the tested gasoline compositions. The car was in other instances stopped immediately after it failed to accelerate, the number of test run cycles being counted, and the spark plugs were likewise inspected. The results of these performance tests are shown in Tables 1 to 3.

EXAMPLE 1 AND COMPARISON EXAMPLE 1

To a lead-free gasoline fraction having an aromatics content of 50 vol.% and a 50% distillation temperature of 106° C. was added 0.3 wt. % of ultrabasic calcium sulfonate (an ultrabasic calcium salt of a petroleum sulfonic acid) thereby to produce a gasoline composition according to the invention. The resulting composition was supplied as a test fuel to a test car of 1,300 cc displacement equipped with a carburetor type fuel supplying system and a manual transmission.

The gasoline composition of the invention and that of a conventional type devoid of ultrabasic calcium sulfonate were both tested with the results shown in Table 1.

EXAMPLES 2 AND 3 AND COMPARISON EXAMPLES 2 AND 3

The details as regards the gasoline compositions of the invention and those of controls are as shown in Table 1 together with test results.

EXAMPLE 4 AND COMPARISON EXAMPLE 4

To a lead-free gasoline fraction having an aromatics content of 47 vol. % and a 50% distillation temperature of 103° C. was added 0.15 wt. % of ultrabasic calcium phenate (an ultrabasic calcium salt of nonylphenol sulfide) to produce a gasoline composition of the invention. The resulting composition was supplied as a test fuel to a test car of 1,800 cc displacement equipped with an injection type fuel supplying system and an automatic transmission.

The gasoline composition of the invention and that of a conventional type devoid of ultrabasic calcium phenate were both tested with the results shown in Table 2.

EXAMPLES 5 AND 6 AND COMPARISON EXAMPLES 5 AND 6

The details as regards the gasoline compositions of the invention and those of controls are shown in Table 2 together with test results.

EXAMPLE 7 AND COMPARISON EXAMPLE 7

To a lead-free gasoline fraction having an aromatics content of 51 vol. % and a 50% distillation temperature of 105° C. was added 0.15 wt. % of ultrabasic calcium salicylate (an ultrabasic calcium salt of a straight alkylsalicylic acid of 14 to 18 carbon atoms) to produce a gasoline composition of the invention. The resulting composition was supplied as a test fuel to a test car of 1,500 cc displacement equipped with a carburetor type fuel supplying system and a manual transmission.

The gasoline composition of the invention and that of a conventional type devoid of ultrabasic calcium salicylate were both tested with the results shown in Table 3.

EXAMPLES 8 AND 9 AND COMPARISON EXAMPLES 8 AND 9

The details as regards the gasoline compositions of the invention and those of controls are as shown in Table 3 together with test results.

It is to be noted as appears in Tables 1 to 3 that Examples 1 to 9 representing the invention are all satisfactory in respect of plug fouling inhibiting ability as evidenced by continued operation of the test car beyond 12 cycles of test run. Controls in Comparison Examples 1 to 9 encountered acceleration failure prior to 12 cycles of test run, resulting in fouled spark plugs.

TABLE 1

| | | | Example 1 | Comparison Example 1 | Example 2 | Comparison Example 2 | Example 3 | Comparison Example 3 |
|---|---|---|---|---|---|---|---|---|
| Test gasoline | Properties | Aromatics content* (vol. %) | 50 | Same as in Example 1 | 40 | Same as in Example 2 | 45 | Same as in Example 3 |
| | | 50% Distillation temperature** (°C.) | 106 | | 95 | | 101 | |
| | Alkali earth metal compound | Type | Compound A | — | Compound A | — | Compound B | — |
| | | Amount (wt. %) | 0.3 | | 0.1 | | 0.2 | |
| Performance test | Test car | Carburetor/Injector | Carburetor | Same as in Example 1 | Carburetor | Same as in Example 2 | Injector | Same as in Example 3 |
| | | Transmission | Manual | | Manual | | Automatic | |
| | | Displacement (cc) | 1,300 | | 1,600 | | 2,000 | |
| | Number of test cycles at which acceleration failed | | >12 | 3 | >12 | 8 | >12 | 6 |
| | Appearance of spark plugs*** | | Normal | Fouling | Normal | Fouling | Normal | Fouling |

*Determined in accordance with JIS K2536
**Determined in accordance with JIS K2254
***Normal: Insulator legs remained light brown or greyish white Fouling: Insulator legs and electrodes covered with deposits
Compound A: Ultrabasic calcium sulfonate (Ultrabasic calcium salt of petroleum sulfonic acid)
Compound B: Magnesium sulfonate (Neutral magnesium salt of synthetic sulfonic acid)

TABLE 2

| | | | Example 4 | Comparison Example 4 | Example 5 | Comparison Example 5 | Example 6 | Comparison Example 6 |
|---|---|---|---|---|---|---|---|---|
| Test gasoline | Properties | Aromatics content* (vol. %) | 47 | Same as in Example 4 | 52 | Same as in Example 5 | 41 | Same as in Example 6 |
| | | 50% Distillation temperature** (°C.) | 103 | | 110 | | 98 | |
| | Alkali earth metal compound | Type | Compound C | — | Compound C | — | Compound D | — |
| | | Amount (wt. %) | 0.15 | | 0.40 | | 0.25 | |
| Performance test | Test car | Carburetor/Injector | Injector | Same as in Example 4 | Carburetor | Same as in Example 5 | Carburetor | Same as in Example 6 |
| | | Transmission | Automatic | | Manual | | Manual | |
| | | Displacement (cc) | 1,800 | | 1,500 | | 1,300 | |
| | Number of test cycles at which acceleration failed | | >12 | 7 | >12 | 2 | >12 | 6 |
| | Appearance of spark plugs*** | | Normal | Fouling | Normal | Fouling | Normal | Fouling |

*Determined in accordance with JIS K2536
**Determined in accordance with JIS K2254
***Normal: Insulator legs remained light brown or greyish white Fouling: Insulator legs and electrodes covered with deposits
Compound C: Ultrabasic calcium phenate (Ultrabasic calcium salt of nonylphenol sulfide)
Compound D: Magnesium phenate (Neutral calcium salt of alkylphenate having $C_5$-$C_8$ alkyl)

TABLE 3

| | | | Example 7 | Comparison Example 7 | Example 8 | Comparison Example 8 | Example 9 | Comparison Example 9 |
|---|---|---|---|---|---|---|---|---|
| Test gasoline | Properties | Aromatics content* (vol. %) | 51 | Same as in Example 7 | 39 | Same as in Example 8 | 46 | Same as in Example 9 |
| | | 50% Distillation temperature** (°C.) | 105 | | 94 | | 99 | |
| | Alkali earth metal compound | Type | Compound E | — | Compound E | — | Compound F | — |
| | | Amount (wt. %) | 0.15 | | 0.15 | | 0.2 | |
| Performance test | Test car | Carburetor/Injector | Carburetor | Same as in Example 7 | Injector | Same as in Example 8 | Injector | Same as in Example 9 |
| | | Transmission | Manual | | Automatic | | Automatic | |
| | | Displacement (cc) | 1,500 | | 1,800 | | 2,000 | |

TABLE 3-continued

| | Example 7 | Comparison Example 7 | Example 8 | Comparison Example 8 | Example 9 | Comparison Example 9 |
|---|---|---|---|---|---|---|
| Number of test cycles at which acceleration failed | >12 | 2 | >12 | 8 | >12 | 5 |
| Appearance of spark plugs*** | Normal | Fouling | Normal | Fouling | Normal | Fouling |

*Determined in accordance with JIS K2536
**Determined in accordance with JIS K2254
***Normal: Insulator legs remained light brown or greyish white Fouling: Insulator legs and electrodes covered with deposits
Compound E: Ultrabasic calcium salicylate (Ultrabasic calcium salt of alkylsalicylic acid having straight $C_{14}$-$C_{18}$ alkyl)
Compound F: Magnesium salicylate (Neutral magnesium salt of alkylsalicylic acid having $C_{16}$-$C_{17}$ straight alkyl)

What is claimed is:

1. A gasoline composition for use as automotive fuel which consists essentially of a gasoline fraction having an aromatics content of 35–60 volume percent and a 50 percent distillation temperature of 85°–125° C., and an alkaline earth metal salicylate in an amount of 0.01–1.0 weight percent based on said gasoline fraction.

2. The gasoline composition according to claim 1 wherein said gasoline fraction has a boiling point of 35°–200° C.

3. A gasoline composition according to claim 1 wherein said alkali earth metal salicylate is an alkali earth metal salt of an alkylsalicylic acid containing at least one alkyl group of more than 3 carbon atoms.

4. A gasoline composition according to claim 1 wherein said alkali earth metal is selected from the group consisting of magnesium, calcium and barium.

5. In an automotive engine containing spark plugs, the method of preventing said spark plugs from fouling, which consists essentially in said engine a gasoline fraction having an aromatics content of 35–60 volume percent and a 50 percent distillation temperature of 85°–125° C., and adding to said gasoline fraction an alkaline earth metal salicylate in an amount of 0.01–1.0 weight percent based on said gasoline fraction.

6. The method according to claim 5 wherein said alkaline earth metal salicylate is an alkaline earth metal salt of an alkylsalicylic acid containing at least one alkyl group of more than 3 carbon atoms.

7. The method according to claim 5, wherein said alkaline earth metal is selected from the group consisting of magnesium, calcium and barium.

* * * * *